United States Patent [19]

Suzumura

[11] Patent Number: 5,033,233

[45] Date of Patent: Jul. 23, 1991

[54] WINDOW REGULATOR DEVICE

[75] Inventor: Hirokazu Suzumura, Toyota, Japan

[73] Assignee: Aisin Seiki Kabushiki Kaisha, Japan

[21] Appl. No.: 610,223

[22] Filed: Nov. 8, 1990

[51] Int. Cl.[5] ..... E05F 11/48

[52] U.S. Cl. ..... 49/352

[58] Field of Search ..... 49/352, 360

[56] References Cited

U.S. PATENT DOCUMENTS

| | | | |
|---|---|---|---|
| 4,494,336 | 1/1985 | Ishii et al. | 49/352 |
| 4,663,886 | 5/1987 | Nakamura et al. | 49/352 X |
| 4,840,080 | 6/1989 | Kobayashi et al. | 49/352 X |
| 4,922,783 | 5/1990 | Wallace | 49/352 X |

*Primary Examiner*—Philip C. Kannan

*Attorney, Agent, or Firm*—Finnegan, Henderson, Farabow, Garrett and Dunner

[57] ABSTRACT

A window regulator device for moving a glass in the vertical direction is comprised of a pair of vertically spaced pulleys, a driving mechanism positioned at a side of a line connecting the pulleys, a wire supported at the pulleys and moved by the driving mechanism, a bracket supporting the glass and connected to the wire to be moved together therewith, a guide member along which the bracket is moved and a supporting member secured to the guide member for preventing the friction engagement between the wire and the guide member.

8 Claims, 2 Drawing Sheets

WINDOW REGULATOR DEVICE

BACKGROUND OF THE INVENTION

1. Field of the Invention

The present invention relates to a window regulator device for moving a window-glass in the vertical direction.

2. Description of the prior art

In general, a conventional window regulator device includes a bracket for supporting a window-glass which is guided in the vertical direction along a guide member. For moving the bracket, a metal wire, which is moved by a motor, is secured to the bracket, so that the glass is moved in the upward or downward direction when the motor is turned on in one or the other direction.

However, in the foregoing structure, while the motor is being turned on, the wire is in sliding friction with the guide member, thereby generating noise. Furthermore, due to the extremely frequent friction between the wire and the guide member, the wire is worn out in the long run, thereby generating the possibility of wire-breaking.

SUMMARY OF THE INVENTION

It is, therefore, a primary object of the present invention to provide a window regulator device without the afore-mentioned drawbacks.

It is another object of the present invention to provide a window regulator device in which friction between a wire and a guide member is prevented.

In order to accomplish the foregoing objects, a window regulator device according to the present invention is provided with a supporting member which is secured to a guide member to be opposed to a wire.

BRIEF DESCRIPTION OF THE DRAWINGS

The above and other objects, features and advantages of the present invention will become more apparent and more readily appreciated from the following detailed description of preferred exemplary embodiment of the present invention, taken in connection with the accompanying drawings, in which.

DETAILED DESCRIPTION OF THE PREFERRED EMBODIMENT

Figure 1:
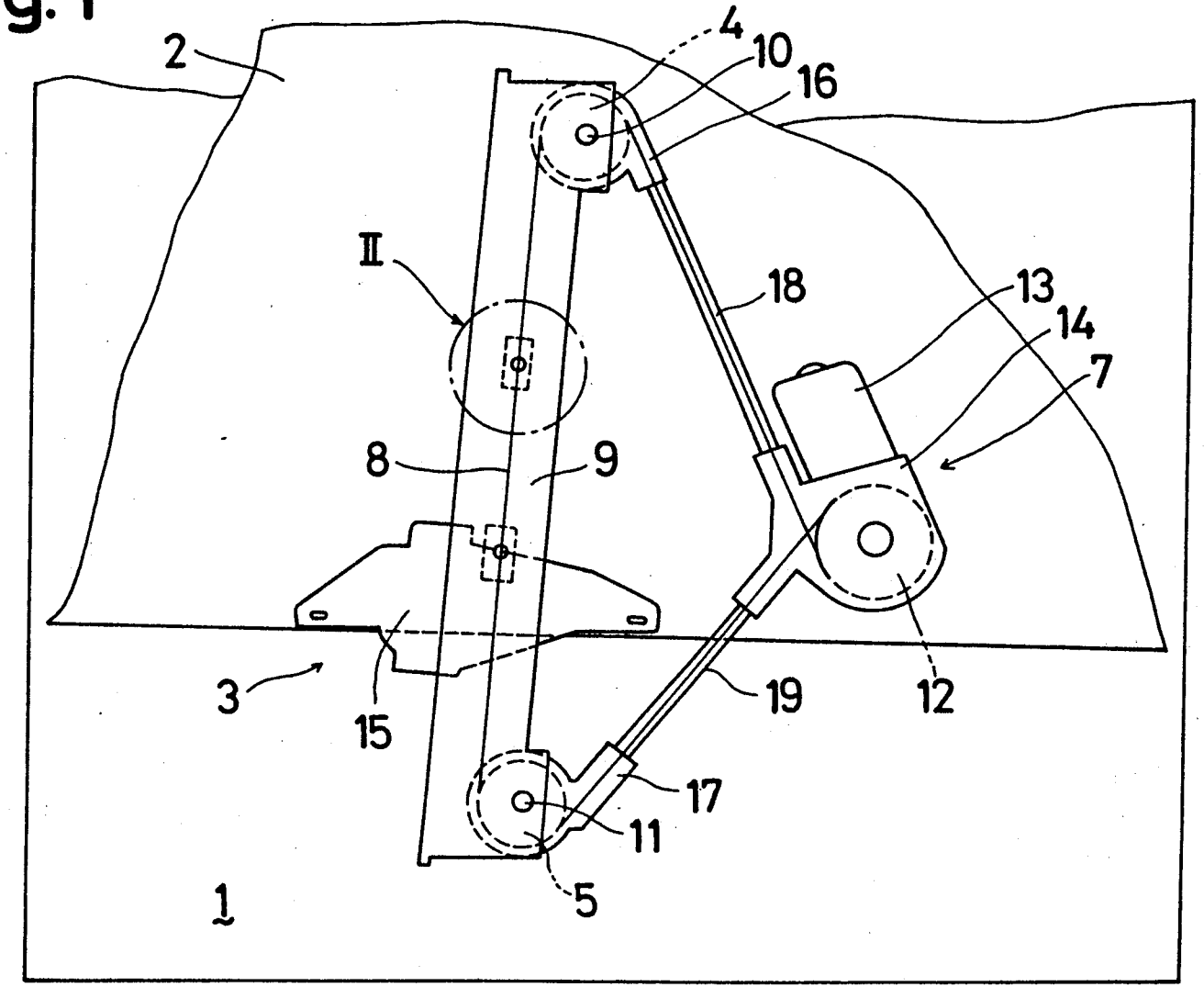
FIG. 1 a view of a window regulator device which is installed in a door.

Referring to FIGS. 1 through 4, a door 1 of a vehicle (not shown) is provided with a window glass or pane 2 which is movable in the vertical direction. A window regulator mechanism 3 for moving the glass 2 in the vertical direction is accommodated in the door 1.

The regulator mechanism 3 includes a pair of vertically spaced pulleys 4 and 5, a driving mechanism 7 positioned at a side position with respect to a line which connects the pulleys 4 and 5 and a wire 8 which is arranged, under tension, in the triangled configuration by being supported at the pulleys 4 and 5 and a drum 12 of the driving mechanism 7.

Figure 2:
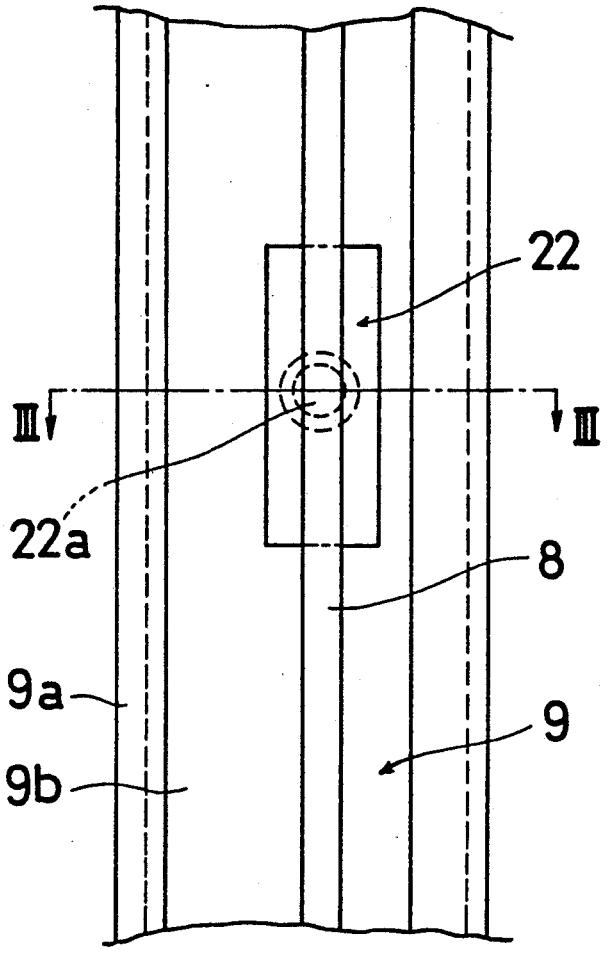
FIG. 2 is an enlarged portion of II in FIG. 1.

The pulley 4 (5) is rotatably supported by a bracket 16 (17) via a pin 10 (11) which is secured to an upper (a lower) portion of a guide member 9. The guide member 9, which is extended in the vertical direction, is fixedly mounted to the door 1. The driving mechanism 7, which includes the drum 12 and a motor 13 for rotating the drum 12, is secured to the door 1 via a bracket 14. The wire 8 is fixedly connected to a bracket 15 which supports an under portion of the glass 2. The bracket 15 is in sliding engagement with a supporting portion **9*a* (as best shown in FIG. 2) of the guide member 9. A pipe 18 (19) through which the wire 8 passes is disposed between the bracket 14 and the bracket 16 (17) for protecting the wire 8** and preventing the interference thereof with other members or parts.

Under the foregoing structure or embodiment, when the drum 12 is rotated by turning on the motor 13, the wire 8 is moved. Due to the resulting wire 8, the bracket 15 is moved in the upward (downward) direction according to the rotational direction of the motor 13, thereby moving the glass 2 in the upward (downward) direction.

Figure 3:
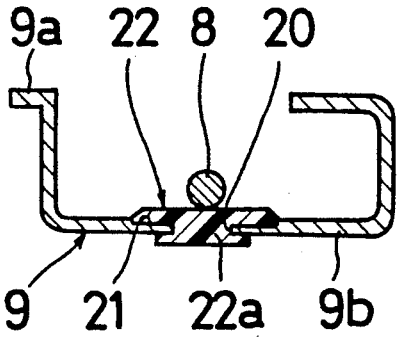
FIG. 3 is a cross-sectional view taken along line III—III in FIG. 2.
Figure 4:
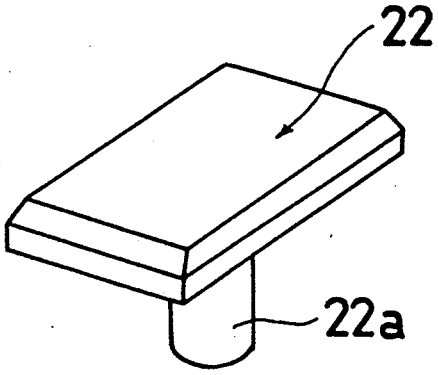
FIG. 4 is a perspective view of a supporting member.

As best shown in FIGS. 2 through 4, two vertically spaced holes 20 are formed in a bottom portion **9*b* of the guide member 9. Around each hole 20, there is formed a stepped portion 21 which is of a rectangular configuration in plane. A supporting member 22 made of an elastic material such as a synthetic resin is fitted within the stepped portion 21 and is disposed between the wire 8 and the bottom portion 9*b* of the guide member 9 for preventing the sliding frictional engagement or interference between the wire 8 and the guide member 9 which results in the worn-out of the wire 8**.

A shaft portion **22*a*, which is formed at a lower side of the supporting member 22 integrally therewith, is passed through the hole 20 and is pressed onto the bottom portion 9*b* of the guide member 9 by a member (not shown) which is heated at a high temperature. The supporting member 22 is formed into a rectangular shape in plane so as to be snugly fitted in the stepped portion 21. In addition, a taper portion is provided at each peripheral of the member 22. Particularly, this taper portion is served for enabling easy transfer of the wire 8. That is to say, before the regulator 3 is attached to the door 1, the wire 8 is in the loose condition which disturbs sometimes the coincidence of the wire 8 with the supporting member 22. After installation of the regulator 3 to the door 1, the wire 8 is adjusted or tensioned so as to be positioned on or above the supporting member 22. During this adjustment, the displacement or transfer of the wire 8 can be attained or performed very easily due to the fact that the wire 8** slides along the taper portion.

Obviously, numerous modifications and variations of the present invention are possible in light of the above teachings. It is therefore to be understood that within the scope of the appended claims, the invention may be practiced otherwise than as specifically described herein.

What is claimed is:

1. A window regulator device for moving a glass in the vertical direction comprising:

a pair of vertically spaced pulleys;

a driving mechanism positioned at a side of a line connecting the pulleys;

a wire supported at the pulleys and moved by the driving mechanism;

a bracket supporting the glass and connected to the wire to be moved together therewith;

a guide member along which the bracket is moved; and a supporting member secured to the guide member for preventing the friction engagement between the wire and the guide member.

2. A window regulator device according to claim 1 wherein the supporting member is made of an elastic material.

3. A window regulator device according to claim 2 wherein the elastic material is a synthetic resin.

4. A window regulator device according to claim 1 further comprising one or more additional supporting members.

5. A window regulator device according to claim 1 wherein the supporting member is secured to the guide member by the snugly fitting manner.

6. A window regulator device according to claim 1 wherein a taper portion is formed on a periphery of the supporting member which is corresponding to the lengthwise direction of the guide member.

7. A window regulator device according to claim 1 wherein the supporting member is secured to the guide member by the pressing manner.

8. A window regulator device according to claim 1 wherein the supporting member is formed into a rectangular configuration in plane.

* * * * *